United States Patent [19]

Franz et al.

[11] Patent Number: 5,052,422

[45] Date of Patent: Oct. 1, 1991

[54] ALL WEATHER APPARATUS FOR CLEANING PIPE THREADS

[75] Inventors: Oskar Franz; John P. Kusz, both of Chicago; Rene G. Laude, Elgin; Donald Racquet, Gurnee, all of Ill.

[73] Assignee: Safety Kleen Corporation, Elgin, Ill.

[21] Appl. No.: 509,993

[22] Filed: Apr. 16, 1990

[51] Int. Cl.[5] ..... B08B 3/02

[52] U.S. Cl. ..... 134/104.2; 134/110; 134/169 R; 220/229

[58] Field of Search ..... 134/104.2, 404.3, 109, 134/104.4, 110, 166 R, 169 R; 220/229, 255, 1 C, 219, 573, 244, 225

[56] References Cited

U.S. PATENT DOCUMENTS

| | | | |
|---|---|---|---|
| 2,385,393 | 9/1945 | Wilson | 134/104.4 |
| 2,627,862 | 2/1953 | Hoerner | 134/104.4 X |
| 3,308,840 | 3/1967 | Kelley | 134/110 X |
| 3,739,715 | 6/1973 | Ambrose | 220/255 X |
| 3,971,394 | 7/1976 | Osborne | 134/104.4 |
| 4,037,754 | 7/1977 | Wilhelmi et al. | 220/229 |
| 4,053,084 | 10/1987 | Anderson | 220/229 |
| 4,401,131 | 8/1983 | Lawson | 134/184 X |
| 4,637,413 | 1/1987 | Llewellyn et al. | 134/111 |
| 4,651,887 | 3/1987 | Patrick | 220/255 X |
| 4,672,985 | 6/1987 | Monr | 134/111 |
| 4,679,700 | 7/1987 | Tharrington et al. | 220/229 X |

FOREIGN PATENT DOCUMENTS

| | | | |
|---|---|---|---|
| 2143511 | 3/1973 | Fed. Rep. of Germany | 220/225 |

*Primary Examiner*—Frankie L. Stinson

*Attorney, Agent, or Firm*—Lockwood, Alex, Fitzgibbon & Cummings

[57] ABSTRACT

A mobile apparatus for supply and collection of cleaning fluids used in field cleaning of pipe threads preparatory to oil field drilling operations is described. The apparatus includes a moveable cart structure defined by a chassis with wheels. An upper frame member is connected to the chassis by a plurality of scissor jack assemblies which may be independently extended or contracted to raise and lower the upper frame with respect to the chassis. A basin for receiving pipe thread cleaning solution is affixed to the movable upper frame member and depends therefrom. A flow control cover including a pair of pivotable panels interleaved at their inner ends over the central portion of the basin is provided to substantially cover the basin. The panels are movable to an inwardly sloping position to collect and funnel cleaning fluid back into the basin for periods of active use. The panels may also be moved to a raised sloping position to provide a protective roofing cover to prevent ingress of environmental moisture or particulates into the basin. Shrouding elements may be secured to the upper frame to provide water tight seams along the sides of the flow control panels. A hose and pump assembly may be included to withdraw fluid from the basin for use or to remove spent fluids. The apparatus includes features which permit it to be stored out of doors in the field without risk of contamination to or from the environment.

10 Claims, 4 Drawing Sheets

ALL WEATHER APPARATUS FOR CLEANING PIPE THREADS

The present invention relates generally to a specialty cleaning apparatus intended primarily for use in or near oil fields. More particularly, it relates to a movable apparatus containing cleaning fluids for use in cleaning the threaded portions of pipes used in oil field drilling operations.

In the oil field industry, a drilling operation involves sequentially connecting separate lengths of pipe or casing to a drilling bit fixture which is rotated by the oil drilling rig. The drill bit is pushed downwardly into the earth and a rotary motion is imparted to the drill bit by rotating the pipe or casing from an above-ground location. After the drilling rig has advanced the drilling bit vertically a given increment of length, the drilling operation may be temporarily discontinued or may be continued while an additional length of pipe or casing is positioned for engagement by the jaws of the drilling fixture. Thereupon, drilling is begun again, and this sequence continues until it is desired to cease the drilling operation.

Drilling operations often involve vertical penetrations of hundreds or even thousands or tens of thousands of feet, and such drilling requires continual additions to the great length of pipe already in use. Whether shallow or very deep well drilling is involved, it is exceptionally important that there be no leakage or weakness in the pipe joint areas. Consequently, the threads used in oil field pipe or casing are highly precise, and specially designed to insure that a strong, precisely fitted joint will be formed where two of the pipes connect.

In the conduct of oil field operations, it is common to leave the pipe or casing used in drilling in an outdoor atmosphere, inasmuch as the number of pipe lengths required in a given drilling operation is very large and indoor storage is impractical. In this connection, the pipe itself is highly weatherproof, except for the specially threaded areas in the pipe. Most if not all drilling pipe includes a male and a female end. Each end is provided with a substantial length of thread of a particular cross-section intended to provide the extremely tight seal and strong mechanical connection required in oil field drilling conditions. It is customary therefore to situate a significant supply of pipe in a given area more or less adjacent a drilling site and have it remain unprotected until the time for use approaches.

After outdoor storage and prior to use, it is necessary to expend significant effort in cleaning the threaded portions of the pipe, both male and female, as the pipes are being prepared for the interfitting process immediately preceding the drilling operation. Because of the size and weight of the pipe, particularly pipes of larger diameters, it is not practical to move the pipe to a location for cleaning and then remove the pipe from this location to still another location for short term storage or fitting to adjacent pipe sections. Therefore, it has become customary to clean pipe threads in the field.

Pipe thread cleaning operations traditionally involve the use of hand labor with solvent and brushes to clean the pipe to the degree necessary to insure formation of a satisfactory seal between adjacent pipe sections. Again, because of the size and shape of the pipe, and because of the possibility of environmental damage arising from spillage of the cleaning liquid on the ground, it has been required to position a supply of pipe cleaning liquid beneath the end of the pipe section being cleaned and to maintain it there until the next section is to be cleaned. Consequently, pipe thread cleaning is best accomplished by an apparatus which is portable so that it may be situated beneath the ends of the pipes to be cleaned.

Moreover, it is desirable to have a cleaning apparatus which may be raised or lowered so that its fluid receptacle portion may be positioned just beneath the pipe section to be cleaned. In this connection, it is desired to recover the major part of solvent resulting from the cleaning operations rather than permitting the solvent to be lost to the ground or other surrounding areas. Environmental considerations and the expense of lost cleaning liquid both strongly dictate that there be minimum spillage or solvent lost during the cleaning operation.

Referring now to the state of the art, and more particularly to solvent cleaning apparatus used in the past, one of the shortcomings commonly associated with such prior art apparatus is the inability to provide a reliable cover for the solvent reservoir. In some cases, if a lightweight removable cover is provided, it is subject to being blown off by strong winds incident to storm conditions in the oil fields. In many areas, such as the southwest portions of the United States, violent storms are a common occurrence. Consequently, lightweight, readily portable covers are not practical or desirable for a cleaning apparatus.

Accordingly, more ponderous, heavy-duty covers have been provided, but these covers have proven difficult to manipulate and, if separate from the machine, their installation after use is frequently simply forgotten or, because of their weight intentionally avoided. Consequently, a continuing strong need exists for a cleaning apparatus which includes a combination of protective means for the solvent supply receptacle as well as means for insuring that cleaning solvent is recovered from the cleaning operation and is not lost to the area surrounding the pipe ends.

SUMMARY OF THE INVENTION

Accordingly, to overcome the shortcomings in prior art devices used in cleaning pipe threads, it is an object of the present invention to provide an improved pipe thread cleaner apparatus which includes a readily positionable receptacle supported on a chassis which includes a multi-purpose flow control assembly for protecting the cleaning fluid receptacle on the one hand from rain, dust and other contaminents and which, on the other hand functions to collect cleaning fluid impinging on the flow control assembly.

It is another object of the invention to provide an apparatus which is simple in operation and rugged and reliable in use.

It is a further object of the invention to provide an apparatus wherein a simplified mechanism is provided for protecting the cleaning liquid receptacle and for collecting cleaning fluid, which forms an integral portion of the machine which may be moved between different positions of use with great simplicity and reliability.

It is still another object of the invention to provide an apparatus wherein the cleaning fluid receptacle may be positioned relative to the threaded pipes and to the chassis of the apparatus by a plurality of reliable positioners which may be adjusted independently of each other for purposes of leveling or otherwise.

It is a further object of the invention to provide an apparatus including a pair of opposed drain panels adapted to cooperate with each other to collect liquid in one position and to repel it in the other.

It is another object of the invention to provide an apparatus for pipe thread cleaning which includes a manually operable pump of simple and reliable construction.

It is a further object of the invention to provide a multi-purpose pipe thread cleaning apparatus which may be reliably left in an exterior environment which is protected from precipitation or other environmental factors damaging or diluting the supply of cleaning liquid and which minimizes the risk of adverse effects to the environment arising from the cleaning operation.

Finally, it is still another object of the invention to provide an apparatus in which the cleaning liquid may be readily removed and replaced without the necessity for moving the apparatus and without risk of damage to the environment.

In accordance with these and other objects, the invention provides a mobile apparatus for supplying and collecting cleaning fluids. The new and improved apparatus of this invention includes a chassis assembly, a receptacle assembly, means carried by the chassis for adjustably positioning the receptacle assembly and a multi-purpose assembly adapted in one position of use to cover and protect the receiving means against entry of rain or the like and in another position of use to assist in collecting cleaning fluid impinging thereon and directing it to the interior of the receptacle.

According to the invention, the requirements are able to be met in an economical and reliable manner by providing a pipe cleaner apparatus of a relatively portable nature, which includes a receptacle for cleaning liquid, a chassis, and means for positioning a receptacle near the pipe ends, as well as a multi-piece flow control assembly serving to protect the receptacle area and also to provide a collection function.

In one preferred form, the apparatus includes an adjustably positionable receptacle mounted for movement on a chassis assembly, with the receptacle including means for receiving a supply of liquid used in the thread cleaning operation. In a preferred form, the apparatus includes a multi-purpose assembly which serves, in one position, to confine and collect cleaning fluid by directing it toward the sump portion of the receptacle, and in another position, to protect the receptacle against contamination by rain, dust, or the like incident to outdoor storage and use.

In its presently preferred form, the receptacle unit includes a pair of opposed shroud elements with vertical sidewalls, and the panels making up the multi-purpose assembly are pivotally mounted units having opposed lateral edges with wiper lips to prevent passage of liquid between the panel and the sidewalls of the receptacle to prevent fluid leakage in that area.

The apparatus of the invention is suited for movement to position adjacent and beneath the ends of pipes to be cleaned, which pipes are usually stored on the outside of buildings or other protection. Thus, the cleaning apparatus may remain outside on the job site without need for external protection to keep the contents of the cleaning liquid receptacle free from water and dirt.

Other objects and advantages of this invention will be apparent from the following detailed description of the preferred embodiments of the invention taken in conjunction with the Drawings in which:

DETAILED DESCRIPTION OF THE PREFERRED EMBODIMENT

Figure 1:
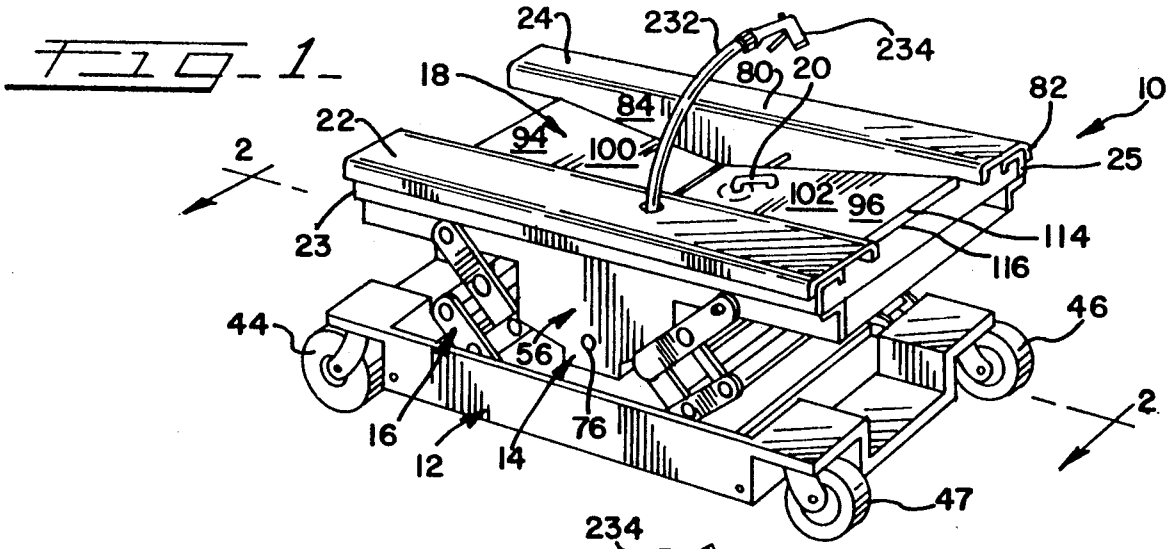
FIG. 1 is a perspective view of the new and improved pipe thread cleaner apparatus of the present invention showing the apparatus in a raised, extended cleaning position with the flow control assembly in a fluid collecting position for directing cleaning fluids into the cleaning fluid receptacle.
Figure 2:
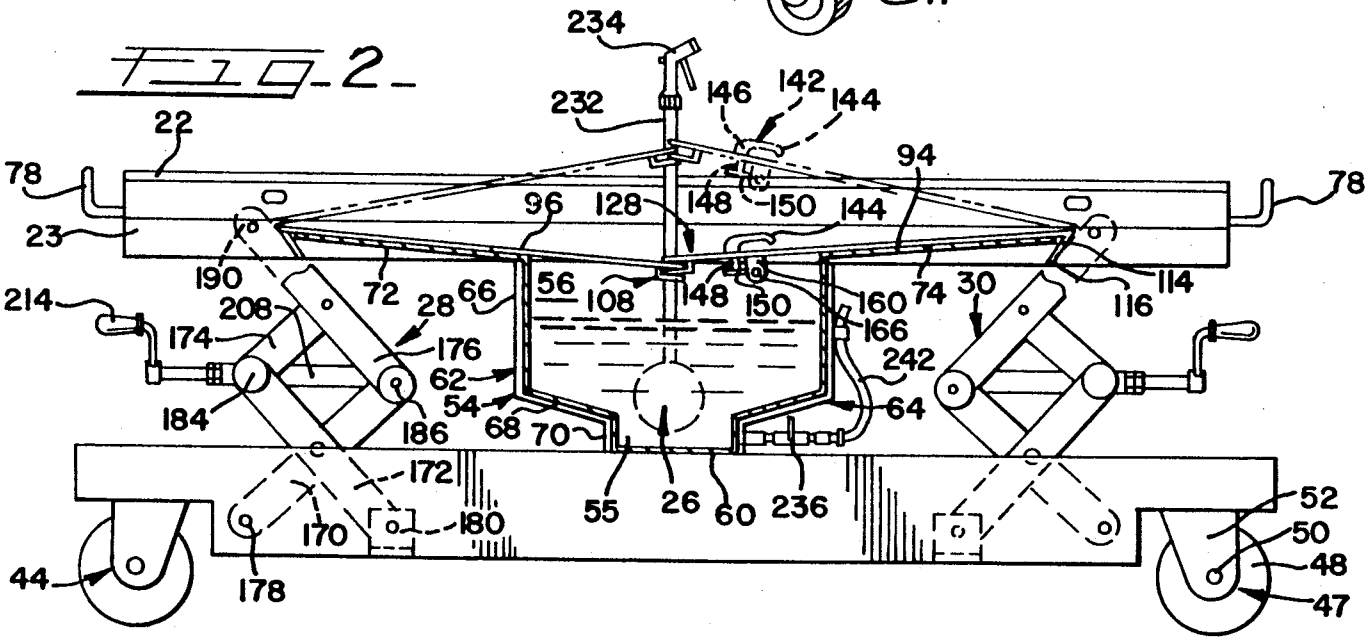
FIG. 2 is an enlarged cross sectional view of the new and improved cleaning apparatus taken along view lines 2—2 of FIG. 1 and showing in phantom lines the environmentally protective position of the flow control assembly.
Figure 3:
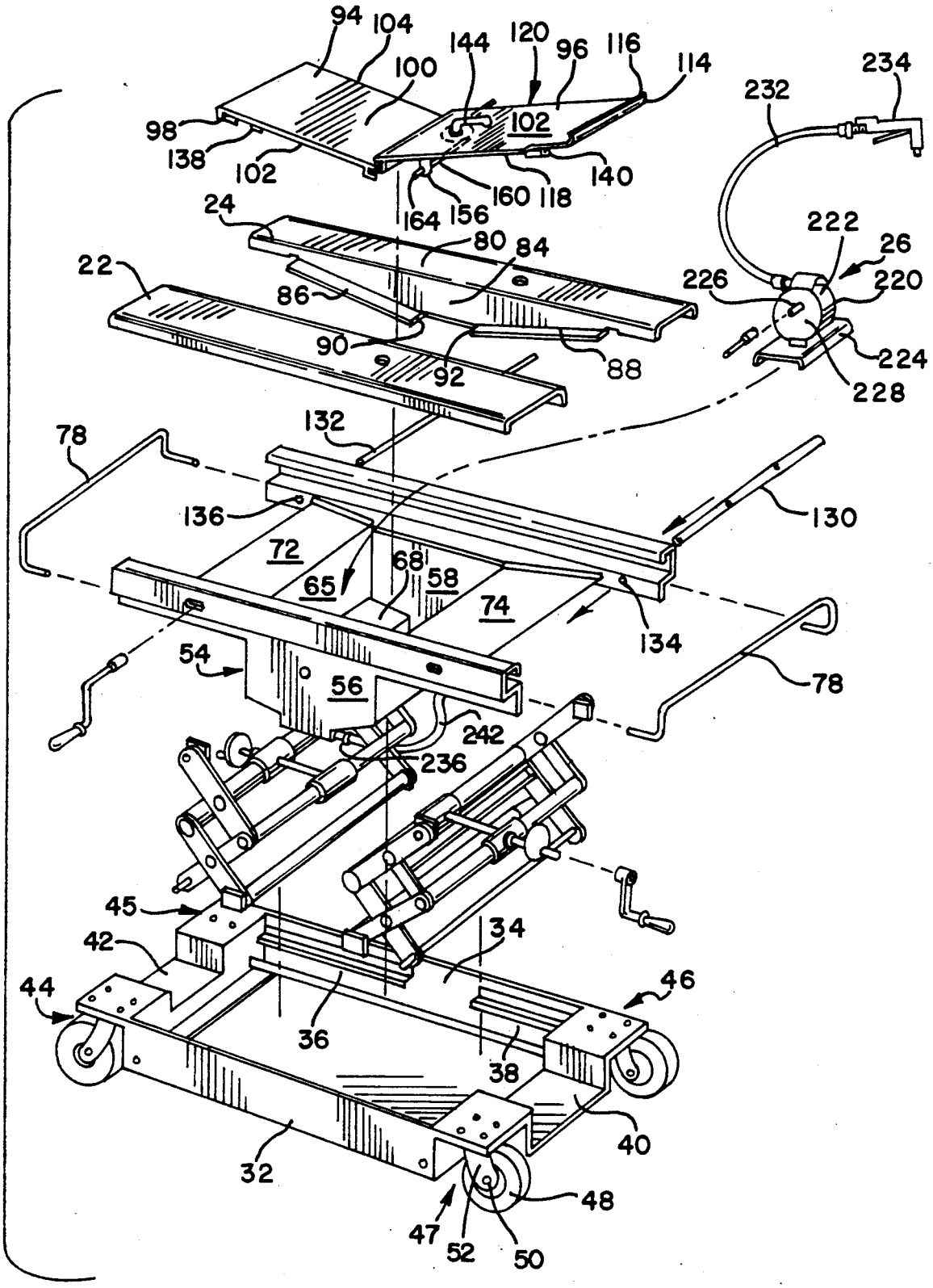
FIG. 3 is an exploded perspective view of the new and improved cleaning apparatus of the present invention.

Referring now to FIGS. 1–3, the present invention provides a new and improved mobile pipe thread cleaner apparatus generally designated by reference numeral 10. Pipe thread cleaner apparatus 10 includes a number of principal assemblies or elements, each of which may in turn be constructed from a number of other parts or components.

More particularly, apparatus 10, as shown in FIGS. 1–3, includes a chassis assembly generally designated 12, a receptacle assembly generally designated 14, and means generally designated 16 for adjustably positioning the receptacle assembly 14 relative to the chassis 12. In addition, apparatus 10 includes a multi-purpose flow control assembly, generally designated 18, and best shown in FIGS. 3 and 6–8 for serving the functions of protecting the receptacle 14 against entry of rain and particulate matter in one position of use and also, in another position of use, to aid in collecting cleaning fluid and directing it to the lowermost or sump portion of the interior of the receptacle assembly 14. In addition, a panel locking mechanism, generally designated 20, is provided to secure the various portions of the flow control assembly 18 in their respective positions of use.

Other elements of the apparatus include left and right hand receptacle frame shrouds, generally designated 22, 24 respectively, for covering upper frame portions 23, 25 of the receptacle assembly 14, and a pump assembly, generally designated at 26. In addition, the receptacle positioning assembly 16 in turn includes left and right hand scissor jack sub-assemblies 28, 30, each in turn consisting of a number of elements, to be more particularly described hereinafter.

Referring now to the construction of the various individual elements, the chassis assembly 12 is shown to include left and right hand longitudinally extending frame members 32, 34, each of which includes a pair of inwardly facing jack locator channels such as the channels 36, 38 on the frame member 34. Counterparts of the jack locator channels 36, 38 are also present on the left hand frame member 32, although they are not shown in FIG. 3. The longitudinal frame members 32, 34 are secured to each other by front and rear cross members 40, 42 shown in FIGS. 1 and 3. Four wheel support assemblies generally designated 44–47 are formed by plates extending from the respective ends of the longitudinal and cross frame members 32, 34, 40, and 42. Each wheel support assembly is substantially identical, and each includes a wheel unit 48, mounted for rotation about an axle 50 carried by a fork 52 having its upper end (not shown in detail) journaled in appropriate bearings or the like in a known manner so as to permit the fork and wheel 48, 52 to swivel in any convenient direction.

Referring now to the receptacle assembly 14, this unit is shown to include a basin unit, generally designated 54 in FIGS. 2 and 3 and shown to include a lowermost or liquid-receiving sump portion 55 (FIG. 2) defined by a pair of end walls 56, 58, a bottom wall 60, and a pair of opposed contoured sidewalls generally designated 62, 64. The sidewall 62 is shown to include an upper sidewall section 66, an intermediate, tapering wall section 68, and a lower vertical wall section 70. The sidewall 64 is made up of similar sections disposed opposite their counterparts just enumerated. Affixed to and extending outwardly from the upper edge of the upper sidewall section 66 is a slightly inclined drain board 72, having its inner end lower than its outer end so as to direct fluid impinging thereon back to the interior of the basin 54. A counterpart drainboard 74 is associated with the other sidewall 64. The upper portions of the basin end walls 56, 58, and the lateral edges of the drain boards, 72, 74 are permanently affixed to left and right hand upper frame portions 23, 25 to provide rigidity for the structure of the receptacle assembly 14 as a whole.

In addition to the elements just described, the basin 54 preferably includes an opening 76 in one of its end walls 56 for reception of the hub end of a pump crank described elsewhere herein. A pair of pull bars or handles 78 (FIG. 2) extend between the outer ends of the upper frame portions 23, 25 to assist in pulling the unit 10 from one location to another.

Referring again to FIGS. 1–3, the construction of the shrouds 22,24 for the receptacle frame is shown. While one shroud 22 is preferably larger than the other shroud 24 for purposes of extending over a portion of the pump assembly in a manner to be described, the units 22, 24 are similar in their main elements and functions, and accordingly, only the right hand unit 24 will be described in detail. This shroud 24 is shown to include a top surface portion 80, an outer sidewall 82, and an inner sidewall sealing surface 84. As shown in FIG. 3, extending inwardly from the tapered lower portions of the sidewall 84 are first and second drain panel support flanges 86, 88. These flanges 86, 88 have their axially inner edge portions 90, 92 spaced apart from each other by a short distance, for example three or four inches.

For purposes of obtaining a substantially liquid-tight seal, it is preferred that the inner sidewall sealing surfaces, such as the surface of the wall 84, be smooth and vertical.

Referring now to the multi-purpose flow control assembly 18, which acts to drain liquid either away from or toward the basin 54, this unit 18 includes opposed, first and second cooperating drain control panels generally designated 94, 96.. The panel 94 includes a down turned outer margin 98, a principal collection surface 100, and a pair of wiper lips 102, 104. At its inner end, and referring now in particular to FIG. 8, the panel 94 is shown to have a free inner edge 106, and to include therebeneath a locating channel assembly generally designated 108 having a generally U-shaped configuration and shown to include a movement-limiting lower flange 110 kept spaced apart from the edge 106 of the panel 110 by an offsetting leg 112. A similar form of engagement is provided for the other drain flow control panel 96, which is shown in FIGS. 1–2 to include an outer, turned down margin 114 terminating in a free edge 116. The panel 96 also includes wiper lips 118, 120 on opposite sides of the collection surface 122. The innermost free edge 124 of the panel 96 also includes a U-shaped locating channel generally designated 126 including a movement limiting lower flange 125 and offsetting leg 127 which cooperates with the u-shaped channel 108 on panel 94.

Figure 8:
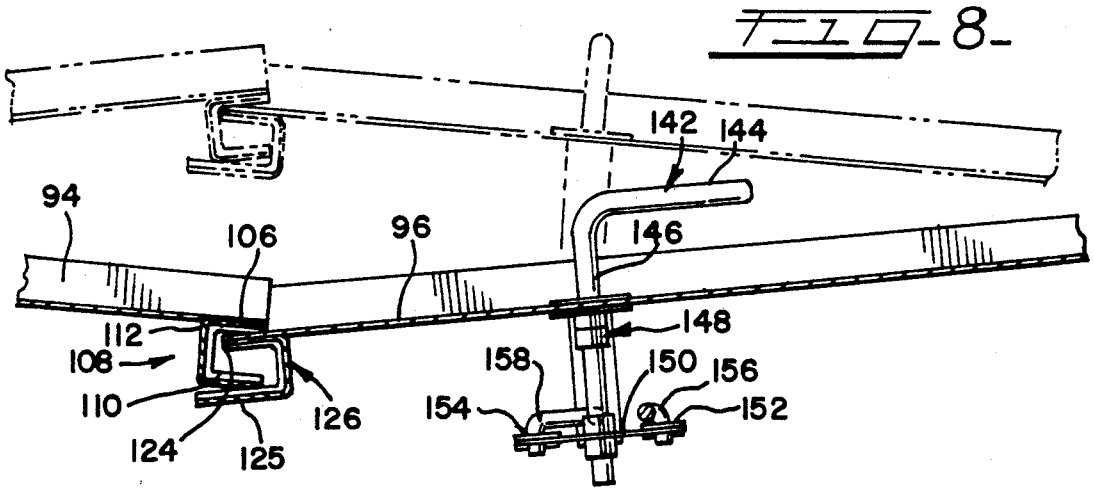
FIG. 8 is an enlarged fragmentary cross sectional view of the flow control assembly and panel locking mechanism taken along view lines 8—8 in FIG. 6 and showing the panels in their protective position in phantom lines.

More particularly, and referring to FIG. 8, the innermost free edge 124 of panel 96 is received within the u-shaped locating channel 108 on panel 94. As shown therein, free edge 124 is engaged between free end 106 and movement limiting lower flange 110 on panel 94. Lower flange 125 on panel 96 is disposed adjacent the underside of lower flange 110. With this interleaving or interdigitating arrangement, the flange edge 110 is always captive within the channel 126, and the interleaved or interdigitated labyrinth formed by cooperative engagement of the locating channel assemblies 108 and 106 diverts liquid flow either away from or toward the basin 54, depending on the position of the panels 94, 96.

Alternatively, as shown in FIG. 2, free end 106 of panel 94 may be received within u-shaped locating channel 126 on panel between free edge 124 and flange 125 to provide the cooperative labyrinth structure.

Moreover, as shown in FIG. 3, outer margin 114 of flow control panel 96 may be upturned instead of downturned. Upturning the outer margins provides a collection area or trough for pooling residual fluids retained on collection surfaces 100 and 102, when the panels are moved to their raised position. More particularly, oil and tar residues may cling to collection surfaces 100 or 102 in use with the panels 94 and 96 being in their lowered collecting position. Thereafter, when the panels are raised to a protective position, the residual materials may tend to run off surfaces 100 and 102 onto the ground. By providing an upturned margin 114, as in FIG. 3, the residual materials running off of surfaces 100 and 102 may be pooled adjacent the base of the upturned margin 114 instead of running off onto the ground. The collected residues may be wiped or removed with a cloth prior to the next use of the apparatus.

Referring again to FIG. 3, the opposed outer or remote ends of the drain panels 94, 96, are arranged for pivotal movement about the respective axes of a pair of spaced apart hinge rods 130, 132. These hinge rods 130, 132 extend through appropriately positioned openings in the upper frames 23 and 25, including the openings 134, 136 in the upper receptacle frame portion 25. In the preferred form of apparatus, the pivot rods 130, 132 extend through openings in aligned and opposing pairs of hinge ears 138, 140 (two only shown in FIG. 3) extending downwardly from the under-surface of the drain panels 94, 96. With the panels 94, 96, thus located for movement of their proximate ends through an arc between the open and closed positions shown in the respective broken and solid line positions of FIGS. and 8, liquid impinging on the upper panel surfaces 100, 122 will be directed toward the interior of the basin 54 or outwardly of the remote edges of the panels adjacent the outer ends of apparatus 10.

Figure 6:
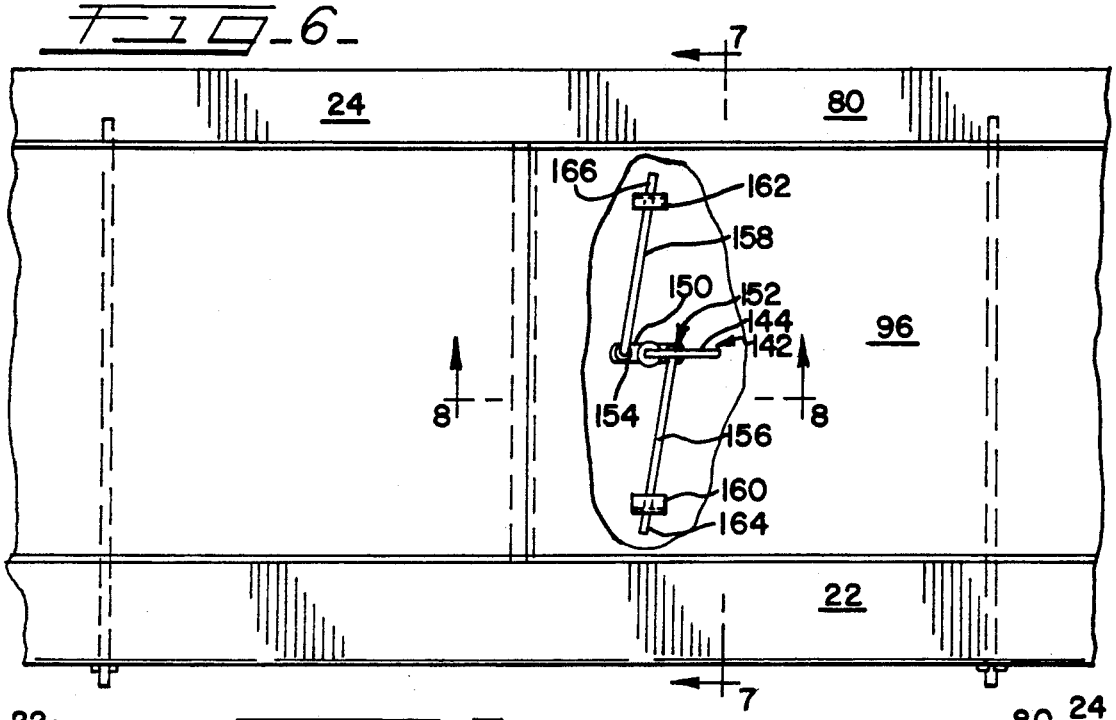
FIG. 6 is a fragmentary top plan view of the new and improved cleaning apparatus of the invention with portions cut away to show the panel locking mechanism for securing portions of the flow control assembly in its various positions of use.
Figure 7:
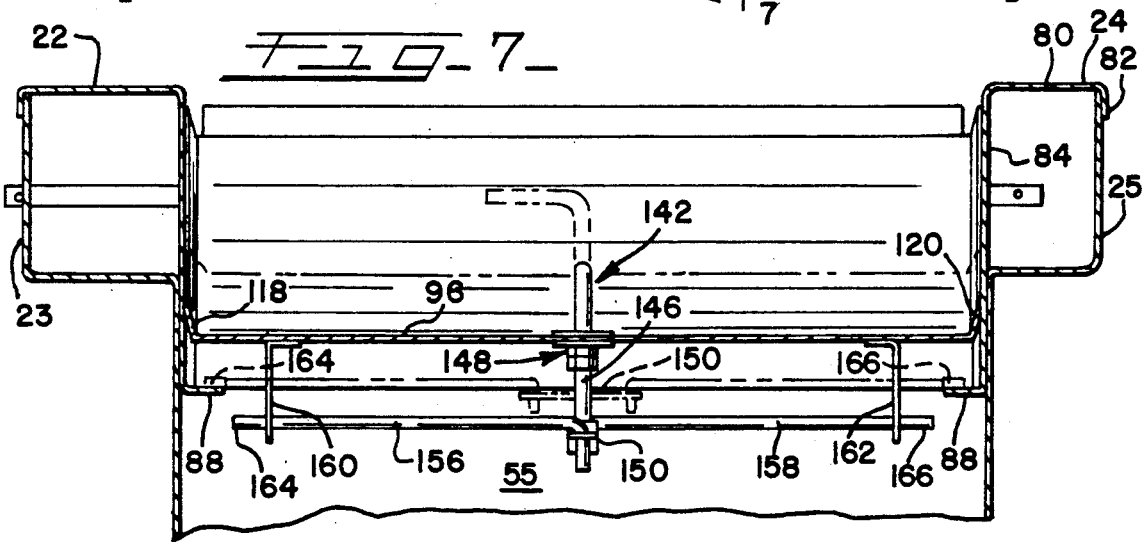
FIG. 7 is a fragmentary elevated cross sectional view of the panel locking mechanism taken along view lines 7—7 in FIG. 6.

Control of movement between the open and closed positions is achieved by the provision of a panel locking mechanism, generally designated 20, and shown to include a locking handle generally designated 142, which includes a gripping portion 144 and a lower shank 146. The handle is secured by a cotter pin and washer arrangement designated 148 to a rotatable locking bar carrier 150, which includes openings 152, 154 for receiving the turned down end portions of locking bars 156, 158, respectively. The outer ends of the bars 156, 158 pass through locating ears 160, 162 depending from the lower surface of panel 96 as shown in FIGS. 6–7. Rotation of the handle in a ninety degree clockwise direction causes the free ends 164, 166 of bars 156 and 158 to move laterally outwardly within locating ears 160 to an extended position. Accordingly, drain control panels 94 and 96 may be moved to their raised protective position by lifting handle grip 144 and rotating it clockwise to permit free ends 164, 166 of bars 156, 158 to restingly and supportedly become engaged on the drain panel support flanges 88, as shown in the dotted line position in FIG. 7. Simply returning the handle to the position of FIG. 6 releases the rod ends 164, 166 from engagement and allows the panels to fall into a lowered position, wherein their under-surfaces are respectively supported by the upper surfaces of the drain panel support flanges 86, 88. The interleaving action of the channels 108, 126 provides a cooperative interdigitated or labyrinth seal for eliminating or minimizing liquid flow of undesirable rain water or the like into the solvent located in sump portion 55. Wiper lips 102, 104 and their counterparts achieve the same purpose of aiding in flow control.

Figure 5:
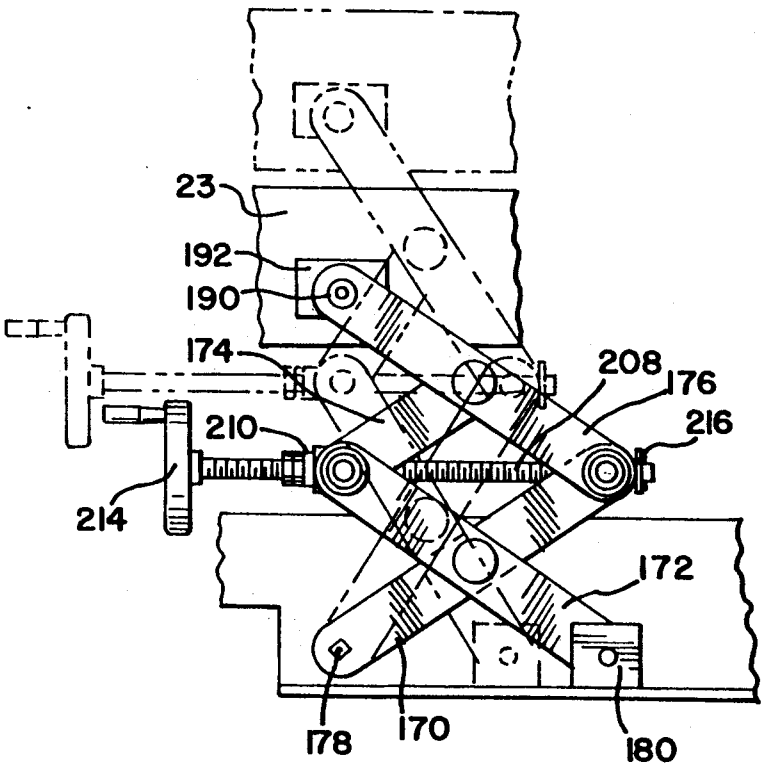
FIG. 5 is a fragmentary side elevation view of the scissor jack assembly showing the raised position of the jack assembly in phantom lines.
Figure 4:
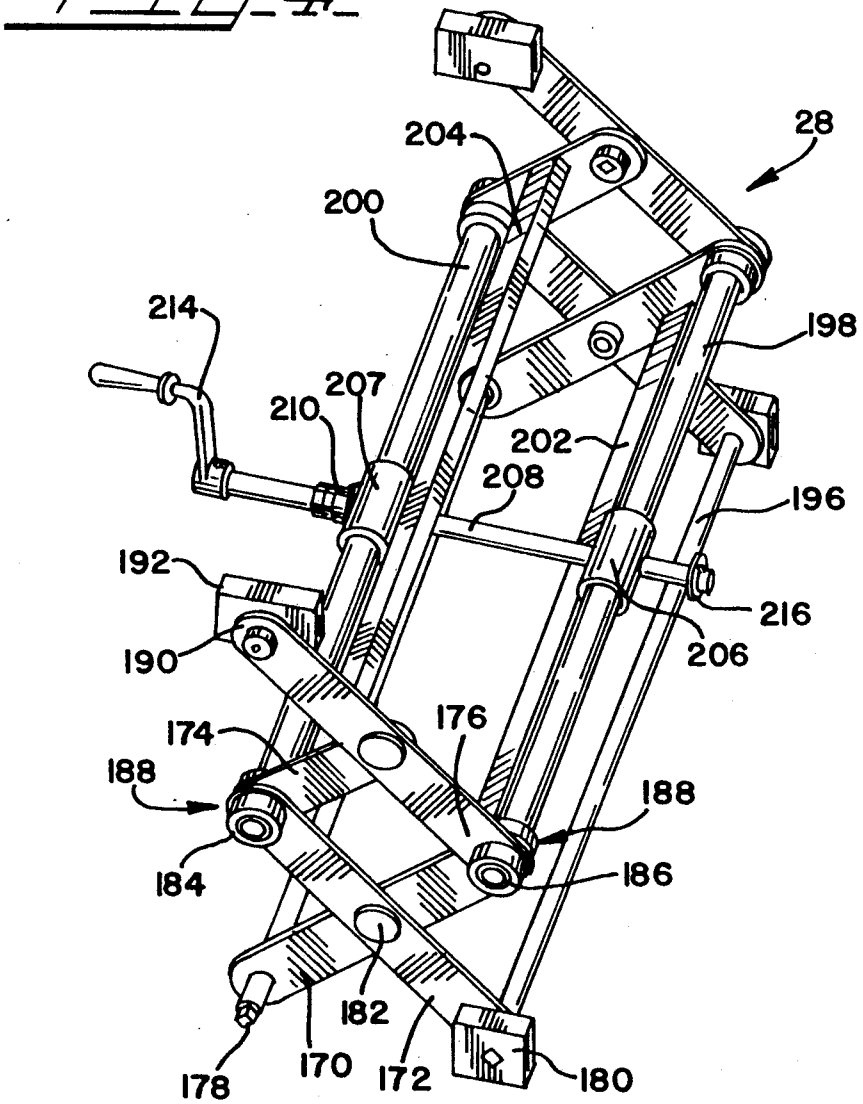
FIG. 4 is an enlarged perspective view of one scissor jack assembly useful for positioning the receptacle of the new and improved cleaning apparatus of the present invention relative to the chassis and the threaded end portion of a pipe to be cleaned.

Referring now in particular to FIGS. 4 and 5, constructional details of the left and right hand scissor jack subassemblies 28, 30 are shown; FIGS. 4 and 5 show one such assembly 28. The principle of the assembly is known to those skilled in the art. In the preferred form shown, not only is the left hand subassembly 28 identical to its counterpart 30, but the right hand side elements of the subassembly 28 are substantially identical to their left hand counterparts. Consequently, the construction of only one side is described in detail, it being understood that the remainder of the mechanism includes elements such as spacers to retain the alignment of counterpart elements to facilitate operation of the screw thread mechanism which is positioned in the centers. Thus, the right hand side of the subassembly 28 includes first and second lower legs 170, 172 and first or shorter and second (or longer) upper legs 174, 176.

The first lower leg 170 includes a fixed end, through which a hinge rod 178 extends. The end on the hinge rod is received in an opening (not shown) in the longitudinal frame member 32. Thus, the lower end of the first lower leg 170 may pivot about the axis of the rod 178 but does not move in a left-to-right sense. The lower end of the second lower leg 172 is pivotally joined to a slide block 180 which is received in use within a jack locator channel (such as channel 36) in the frame member 34. The lower end of the second leg 172 will then move from right to left in use, as will appear. A center pivot 182 joins the lower legs 170, 172 at an intermediate point, and a pair of end pivots 184, 186 are provided to link the upper ends of the lower legs 170, 172 to the lower ends of the upper legs 174, 176. These legs are pivotally secured to each other by a pivotable coupling 188.

The upper end of the upper long leg 176 terminates in a mounting ear 190 for an upper slide block 192. This slide block is positioned for reciprocation relative to and as an associated part of the upper frame 23 of the receptacle assembly 14. As shown, various tie rods 178, 196, 198, 200 extend between pivot points of the mechanism. Further, welded-in spacers 202, 204 also maintain the legs of the scissor assembly in a fixed relation to their counterparts to insure parallel operation.

Each of the larger diameter tie rods 198, 200 includes an enlarged diameter center sleeve section 206, 207 having an opening for the passage of a threaded elevator rod 208. One end of the elevator rod 208 includes a locking collar 210 and a hand crank 214. The other end includes an end stop 216 so that the threaded elevator rod 208 is permitted to rotate but not move axially with respect to the sleeve 206. Rotation of the threaded rod will cause the sleeve sections 204, 206 to move together or apart, thus moving the pivot points 184, 186 together or apart. Moving pivot points 184, 186 together causes movement of the lower slide block 180 relative to the end of the hinge rod 178, causing the linkage as a whole to assume a more or less upright position.

Referring now to FIGS. 2–3, there is shown another optional component which is preferred for use with the apparatus of the invention, namely, a liquid pump assembly generally designated 26. Pump assembly 26 includes a pump 220 which is preferably a manually operated pump of the positive displacement type, having an exterior housing 222, a stand 224, and a rotatable stub drive shaft 226 extending out from the end wall 228 of the housing 222. A pump crank shaft extender 240 extends through the opening 238 in the receptacle sidewall 70 to a free end on which a detachable hand crank 230 may be removably positioned. The pump unit is preferably arranged with its outlet in fluid communication with a hose 232 having an outlet nozzle 234 affixed to the end thereof.

In a preferred embodiment, a locking type shutoff valve assembly 236 with an outlet or drain hose 242 may be provided in the lower vertical sidewall 70 of the receptacle 12, as shown in FIGS. 2 & 3.

In use, the hand crank 230 operates the pump 220 to direct a supply of cleaning liquid through the hose 232 and nozzle 234 toward the pipes to be cleaned, so that the cleaning liquid may be used repeatedly. When the solvent is exhausted or contaminated, then it may be removed to a portable disposal container cranking the pump unit 220 for this purpose, or by opening valve 236 to hose 242 to drain the receptacle 12. Alternatively, an electrically operated or air operated pump might also be used, but since the apparatus 10 is primarily intended for outdoor use remote from available power, the manually operated cranking pump system such as 220 has proven satisfactory.

Referring now to a typical use of the apparatus, apparatus 10 is typically stored with the receptacle in its lowered or retracted position and with the panels 94, 96 in the raised position of use as shown in FIGS. 2 and 8. When it is desired to transport the unit to the work site, the user grasps the handle 78 and rolls apparatus 10 to a position of use, pulling the chassis and the remainder of the unit to a location adjacent the threaded end of a pipe to be cleaned. The swivel mounted wheels enable the unit to be moved and positioned adjacent the work with flexibility and simplicity. Once in position of use, the flow control panels 94, 96 are lowered to the solid line position of FIGS. 2 and 8 by rotating the handle 142 which releases the locking bars 156, 158 and permits the panels to rest on the drain panel support flanges 86, 88. Thereupon, the washing operation commences and whatever fluid is drained from the work site is collected on the panels and directed to the area adjacent the proximate ends of the panels, as shown in FIG. 8. In this connection, inasmuch as the liquid is intended to flow in the space between panels, the channels, such as the channels 108, 126 are adapted to permit fluid flow therebetween in their lowered collecting position. A slight gap of perhaps about three-eights of an inch to permit liquid flow between the panels may be provided. The liquid is thus directed to the sump area 55 at the bottom of the basin unit 54 for continued re-use.

Positioning the receptacle assembly 14 as a whole is achieved by manipulating the respective hand cranks 214, so that the scissor jacks place the receptacle 14 closely underneath the work to minimize splashing and other loss of cleaning liquid. During this phase of the operation, the pump crank 230 may be operated so as to direct solvent to the work site.

After the cleaning operation has been performed, and it is desired to leave the apparatus for a period of time in outdoor storage, it is only necessary to manipulate the locking assembly 20 by grasping the gripping portion 144 of the handle 142, raising the flow control assembly and rotating the handle to the locked position. After the panels 94, 96 are raised to the phantom line position of FIG. 8, the handle 142 is rotated clockwise so that the bar ends 164, 166 of the locking bars 156, 158 are received on support flanges 88, thereby locking the panels 94, 96 in their protective covering position over the sump 55. In this manner, rain and wind-borne debris will be excluded from the cleaning liquid.

According to the invention, the cleaning equipment may be moved adjacent the work site with great convenience. The environmental damage due to spillage is prevented because the pump assembly permits disposition of the used solvent into portable containers, and because the arrangement of drain panels provides an effective way to recover solvent.

The present invention provides a new and improved all weather apparatus for cleaning pipe threads having a number of novel advantages and characteristics, including those referred to specifically herein and others which are inherent in the invention. Although the present invention has been described with reference to a preferred embodiment, modifications or changes may be made therein by those skilled in this art. For example, instead of a manually operated positive displacement fluid pump, other pumping means may be used. Moreover, instead of the scissor jack assemblies, other means for raising and lowering the receptacle assembly with respect to the chassis including mechanical, pneumatic or electrical may be substituted. All such obvious modifications or changes may be made herein by those skilled in this art without departing from the scope and spirit of this invention as defined in the appended claims.

We claim:

1. An mobile apparatus for supply and collection of cleaning fluids used in field cleaning of pipe threads, said apparatus comprising, in combination, a chassis assembly, a receptacle assembly, and means carried by said chassis assembly for positioning said receptacle assembly in a desired position of use relative to pipe threads to be cleaned, said chassis assembly further including a chassis frame and a plurality of wheels positioned with respect to said frame so as to render said chassis readily movable, said receptacle assembly including means for receiving a supply of cleaning fluid, and a multi-purpose flow control assembly adapted, in a first position of use, to serve as a cover for protecting said receiving means against entry of rain and particulate matter, and in a second position of use, to serve as a collector for directing cleaning fluid impinging thereon to the interior of said receiving means, said multi-purpose flow control assembly including first and second drain control panels, means for positioning said panels in said first and second positions, each of said panels having an inner end, an outer end, and means defining a pivot axis lying adjacent said outer end, with each of said inner panel ends including portions of an interlocking mechanism whereby, in said first position, a portion of one of said panel ends overlies the other to prevent liquid flow between panels, and in said second position, portions of each of said panel ends are spaced apart so as to permit liquid flow therebetween.

2. An apparatus as defined in claim 1, wherein said receptacle further includes a pump assembly for withdrawing cleaning fluid from said receptacle.

3. An apparatus as defined in claim 1, wherein said means for positioning said receptacle assembly comprise manually adjustable means for raising and lowering said receptacle assembly relative to said chassis assembly.

4. An apparatus as defined in claim 3, wherein said means for positioning includes a plurality of said manually adjustable means which may be independently adjusted to level said receptacle.

5. An apparatus as defined in claim 1, wherein said means for receiving a supply of cleaning fluid in said receptacle assembly comprises a basin having end, side, and bottom wall portions, and wherein said receptacle assembly further includes drain boards extending outwardly and upwardly from the upper portions of said basin sidewalls.

6. An apparatus as defined in claim 1, wherein said means for positioning said drain control panels in said first position includes a manually operable locking assembly having portions associated with one of said drain control panels, said locking assembly including at least one panel end support element with its outer end portions being arranged for movement and movable between engaged and disengaged positions relative to said means for receiving said supply of cleaning fluid.

7. An apparatus as defined in claim 1, wherein said receptacle assembly further includes a pair of spaced apart shroud elements each having a generally horizontally extending top wall portion supported adjacent to said receiving means, and an inner, generally vertical sidewall portion and wherein each of said drain control panels includes side edge portions positioned for substantially liquid-tight engagement with said vertical walls of said shroud elements in order to prevent flow of liquid between said side edges of said drain control panels and said shroud walls.

8. An apparatus as defined in claim 1, wherein said means for positioning said receptacle assembly include a pair of scissor jack assemblies, each of said assemblies having its lower end secured to said chassis assembly by a fixed pivot point and another leg having its lower end movable relative to said chassis, with both of said scissor mechanisms being linked to each other by a transverse element, said transverse element being actuable by a hand crank and threaded rod arrangement whereby said scissor jack assemblies operate in parallel with each other for positioning said receptacle assembly.

9. A mobile apparatus for supply and collection of fluids used in field cleaning of pipe threads, said apparatus comprising basin means having a top opening for containing a volume of cleaning fluid and positionable adjacent and underneath a threaded end of a pipe to be cleaned, flow control cover means substantially completely covering said top opening, said flow control cover means including first and second drain control panels, each drain control panel having an outer end and an inner end with an inwardly directed generally C-shaped member depending therefrom, the inner ends of said panels being cooperatively engaged such that one inner end and a portion of its depending C-shaped member is interdigitatedly received within the C-shaped member of the opposed inner end, each flow control panel being pivotally connected adjacent its outer end to said basin means adjacent said top opening, said flow control panels being movable between a fluid collecting position wherein the inner ends are disposed downwardly of said top opening to funnel fluid and permit it to flow by gravity between said inner ends and into said basin and a protective storage position wherein the inner ends are disposed upwardly of said top opening to prevent ingress of fluids or contaminents through the top opening into said basin and means for maintaining the flow control panels in their fluid collecting and protective storage positions.

10. A mobile apparatus for supply and collection of cleaning fluids used in field cleaning of pipe threads, said apparatus comprising, in combination, a chassis assembly, a receptacle assembly and means carried by said chassis assembly for positioning said receptacle assembly in a desired position of used relative to pipe threads to be cleaned, said chassis assembly further including a chassis frame and a plurality of wheels positioned with respect to said frame so as to render said chassis readily movable, said receptacle assembly including means for receiving a supply of cleaning fluid, and a multi-purpose flow control assembly adapted, in a first position of use, to serve as a cover for protecting said receiving means against entry of rain and particulate matter, and in a second position of use, to serve as a collector for directing cleaning fluid impinging thereon to the interior of said receiving means, said multi-purpose flow control assembly including first and second drain control panels, means for positioning said panels in said first and second positions, each of said panels having an inner end, an outer end and means defining a pivot axis lying adjacent its outer end, with each of said inner panel ends including portions of an inter-locking mechanism whereby, in said first position, a portion of one of said panel ends overlies the other to prevent liquid flow between panels, and in said second position portions of each of said panel ends are spaced apart so as to permit liquid flow therebetween and said receptacle assembly further including a pair of spaced apart shroud elements, each having a generally horizontally extending top wall portion supported adjacent to said receiving means, and an inner, generally vertical side wall portion and wherein each of said drain control panels includes side edge portions positioned for substantially liquid-tight engagement with said vertical walls of said shroud elements in order to prevent flow of liquid between said side edges of said drain control panels and said shroud walls.

* * * * *